US005159153A

United States Patent [19]

Cranney et al.

[11] Patent Number: 5,159,153

[45] Date of Patent: Oct. 27, 1992

[54] EMULSION THAT IS COMPATIBLE WITH REACTIVE SULFIDE/PYRITE ORES

[76] Inventors: Don H. Cranney, 10535 S. Featherwood, South Jordan, Utah 84065; Blake T. Maxfield, 6614 S. 5095 West, West Jordan, Utah 84084

[21] Appl. No.: 851,114

[22] Filed: Mar. 16, 1992

Related U.S. Application Data

[63] Continuation of Ser. No. 534,554, Jun. 7, 1990, abandoned.

[51] Int. Cl.[5] ..... F42B 3/00; C06B 31/30

[52] U.S. Cl. ..... 102/313; 102/312; 149/2; 149/60; 149/83

[58] Field of Search ..... 149/2, 21, 46, 60, 76, 149/83, 85; 102/312, 313

[56] References Cited

U.S. PATENT DOCUMENTS

| | | | |
|---|---|---|---|
| 3,046,888 | 7/1962 | Gordon | 102/313 X |
| 3,377,909 | 4/1968 | Grant et al. | 102/313 X |
| 4,161,142 | 7/1979 | Edwards et al. | 102/312 X |
| 4,273,049 | 7/1981 | Edwards et al. | 149/2 |
| 4,448,619 | 3/1984 | Mitchell | 149/21 |
| 4,507,161 | 3/1985 | Sujanski et al. | 149/21 |
| 4,722,757 | 2/1988 | Cooper et al. | 149/2 |
| 5,026,442 | 6/1991 | Yabley et al. | 149/2 |

*Primary Examiner*—Peter A. Nelson

[57] ABSTRACT

The water-in-oil emulsion explosives of this invention contain a water-immiscible organic fuel as a continuous phase, an emulsified inorganic oxidizer salt solution as a discontinuous phase, an emulsifier, gas bubbles or an air entraining agent for sensitization, and from about 1% to about 30% by weight of the composition urea for stabilization against thermal degradation with reactive sulfide/pyrite ores. The invention also relates to a method of using such explosives.

8 Claims, No Drawings

EMULSION THAT IS COMPATIBLE WITH REACTIVE SULFIDE/PYRITE ORES

This application is a continuation of application Ser. No. 07/534,554, filed Jun. 7, 1990, and now abandoned.

The present invention relates to an improved explosive composition. More particularly, the invention relates to a water-in-oil emulsion explosive that has increased thermal compatibility with sulfide/pyrite containing ores that typically are reactive with nitrate salts, especially ammonium nitrate.

The water-in-oil emulsion explosives of this invention contain a water-immiscible organic fuel as a continuous phase, an emulsified inorganic oxidizer salt solution as a discontinuous phase, an emulsifier, gas bubbles or an air entraining agent for sensitization, and from about 1% to about 30% by weight of the composition urea for stabilization against thermal degradation with reactive sulfide/pyrite ores. The invention also relates to a method of using such explosives.

As used herein, the term "water-in-oil" will refer to a discontinuous phase of polar or water-miscible droplets emulsified throughout a nonpolar or water-immiscible continuous phase. Such emulsions may or may not actually contain water, and those not containing water sometimes are referred to as "melt-in-oil" emulsions.

BACKGROUND OF THE INVENTION

It is well known that certain ore bodies containing significant amounts of certain sulfides and pyrites, such as iron pyrite, may be reactive with ammonium nitrate or other nitrate salts. In some instances the heat produced in a borehole from the reaction between these ores and explosives containing nitrate salts has caused premature detonations. Frequently, these reactive ores are associated with geothermal regions that can produce high temperatures in boreholes. In addition, boreholes drilled into the ores can become hot due to the reaction of newly exposed ore in the boreholes with air (oxygen). The resulting high temperatures further enhance the reactivity of the ore with nitrate-based explosives.

U.S. Bureau of Mines Reports of Investigation Nos. 7187 and 8373 detail studies in which urea was added to AN or ANFO to repress the reaction with certain sulfide and pyrite containing ores or with ores containing weathering products of these constituents such as ferrous sulfate. Up to 5% urea was reportedly needed to prevent any reaction of the AN with reactive ores. U.S. Pat. No. 3,447,982 discloses the addition of up to 1% powdered urea with a Stengel type AN (crystallized and flaked) to suppress the reaction of such AN with reactive ores. In some cases, the urea was included in the presolidified AN melt. Greater than 1% powdered urea was to be avoided because of increased shock sensitivity. U.S. Pat. No. 3,708,356 extended this approach to porous AN or ANFO wherein up to 1% powdered urea was added to suppress reaction with reactive ores.

It has recently been observed that emulsion explosives are also reactive with some ores, this despite the fact that the oil continuous phase of a stable emulsion serves as a barrier to help reduce direct contact of the internal phase nitrate salts and the ore. It has been found in the present invention that the inclusion of a substantial amount of urea in solution with the nitrate salts of the internal phase of the emulsion greatly reduces or even eliminates reaction of the explosive with the ore.

Water-in-oil emulsion explosives are well-known in the art. They are fluid when formed (and can be designed to remain fluid at temperatures of use) and are used in both packaged and bulk forms. They commonly are mixed with ammonium nitrate prills and or ANFO to form a "heavy ANFO" product, having higher energy and, depending on the ratios of components, better water resistance than ANFO. Such emulsions normally are reduced in density by the addition of air voids in the form of hollow microspheres, other solid air entraining agents or gas bubbles, which materially sensitize the emulsion to detonation. A uniform, stable dispersion of the air entraining agent or gas bubbles is important to the detonation properties of the emulsion. Gas bubbles, if present, normally are produced by the reaction of chemical gassing agents.

SUMMARY OF THE INVENTION

The invention comprises the addition of urea to a water-in-oil emulsion explosive having an organic fuel as a continuous phase, an inorganic nitrate based oxidizer salt solution as a discontinuous phase, an emulsifier and chemically formed gas bubbles or air void containing solid additives. The urea is preferably dissolved in the oxidizer phase but may be added as a powdered or prilled solid phase. The explosive may either be packaged before loading into the borehole or may be bulk delivered. The explosive is compatible with reactive ores containing sulfides or pyrites.

DETAILED DESCRIPTION OF THE INVENTION

As indicated above the addition of urea to an emulsion explosive as a dry powder, dry prill or preferably dissolved in the oxidizer phase greatly reduces the reactivity of the nitrate salts in the emulsion with sulfide/pyrite ores. As low as about 1% dissolved or dispersed urea can have a dramatic effect on explosive/ore compatibility. In practice, larger amounts are advantageous and urea levels up to about 30% are feasible. The degree of effectiveness generally is proportional to the amount of urea employed. However, for reasons of optimizing oxygen balance, energy and effectiveness, the preferred range is from about 5 to about 20% urea.

A urea-treated emulsion has several advantages over a urea-treated ANFO. Firstly, emulsions have well-known advantages in general, i.e., water resistance, higher density and better detonation performance. Secondly, the external fuel phase of an emulsion provides an additional barrier for protection against reaction of internal phase oxidizer salts with the ore. Finally, the intimate mixture of urea dissolved in the nitrate oxidizer solution provides greater and more reliable protection from reaction than the physical mixture of urea with nitrate salts, even with powdered urea.

Another advantage of urea is its eutectic behavior in combination with AN and other nitrate salts. With an appreciable amount of urea present in the oxidizer solution of an emulsion explosive, a relatively lower amount of water is needed to obtain a desired temperature of crystallization of the internal oxidizer phase of the emulsion. The need for less water is particularly advantageous in hot, reactive ore deposits, which may be encountered in sulfide/pyrite ores. In that circumstance, a lower amount of water means less potential volatilization and hence less destabilization.

The immiscible organic fuel forming the continuous phase of the composition is present in an amount of from about 3% to about 12%, and preferably in an amount of from about 4% to about 8% by weight of the composition. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cotton seed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used.

The emulsifiers for use in the present invention can be selected from those conventionally employed, and are used generally in an amount of from about 0.2% to about 5%. Typical emulsifiers include sorbitan fatty esters, glycol esters, substituted oxazolines, alkylamines or their salts, derivatives thereof and the like. More recently, certain polymeric emulsifiers, such as a bis-alkanolamine or bis-polyol derivative of a bis-carboxylated or anhydride derivatized olefinic or vinyl addition polymer, have been found to impart better stability to emulsions under certain conditions.

Optionally, and in addition to the immiscible liquid organic fuel and the urea, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to about 25% by weight.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 0% to about 30%. The oxidizer salt preferably is primarily ammonium nitrate, but other salts may be used in amounts up to about 50%. The other oxidizer salts are selected from the group consisting of ammonium, alkali and alkaline earth metal nitrates, chlorates and perchlorates. Of these, sodium nitrate (SN) and calcium nitrate (CN) are preferred. When higher levels of urea, 10–15% by weight or more, are dissolved in the oxidizer solution phase, solid oxidizer preferably should be added to the formed emulsion to obtain optimal oxygen balance and hence energy. The solid oxidizers can be selected from the group above listed. Of the nitrate salts, sodium nitrate is preferred because of its lower reactivity with the problem ores and because of its high oxygen content. An oxygen balanced product would be particularly necessary in underground applications where noxious fumes would be a problem.

Water preferably is employed in amounts of from about 1% to about 30% by weight based on the total composition. It is commonly employed in emulsions in an amount of from about 9% to about 20%, although emulsions can be formulated that are essentially devoid of water. With higher levels of urea, such as 15% or more, the compositions easily can be made anhydrous.

Water-miscible organic liquids can at least partially replace water as a solvent for the salts, and such liquids also function as a fuel for the composition. Moreover, certain organic compounds also reduce the crystallization temperature of the oxidizer salts in solution. Miscible solid or liquid fuels in addition to urea, already described, can include alcohols such as sugars and methyl alcohol, glycols such as ethylene glycols, amides such as formamide, amines, amine nitrates, and analogous nitrogen-containing fuels. As is well known in the art, the amount and type of water-miscible liquid(s) or solid(s) used can vary according to desired physical properties. As already explained it is a particular advantage of this invention that substantial urea lowers the crystallization point of the oxidizer solution.

Chemical gassing agents preferably comprise sodium nitrite, that reacts chemically in the composition to produce gas bubbles, and a gassing accelerator such as thiourea, to accelerate the decomposition process. A sodium nitrite/thiourea combination produces gas bubbles immediately upon addition of the nitrite to the oxidizer solution containing the thiourea, which solution preferably has a pH of about 4.5. The nitrite is added as a diluted aqueous solution in an amount of from less than 0.1% to about 0.4% by weight, and the thiourea or other accelerator is added in a similar amount to the oxidizer solution. In addition to or in lieu of chemical gassing agents, hollow spheres or particles made from glass, plastic or perlite may be added to provide density reduction.

The emulsion of the present invention may be formulated in a conventional manner. Typically, the oxidizer salt(s), urea and other aqueous soluble constituents first are dissolved in the water (or aqueous solution of water and miscible liquid fuel) at an elevated temperature or from about 25° C. to about 90° C. or higher, depending upon the crystallization temperature of the salt solution. The aqueous solution, which may contain a gassing accelerator, then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution). Stirring should be continued until the formulation is uniform. When gassing is desired, which could be immediately after the emulsion is formed or up to several months thereafter when it has cooled to ambient or lower temperatures, the gassing agent and other advantageous trace additives are added and mixed homogeneously throughout the emulsion to produce uniform gassing at the desired rate. The solid ingredients, if any, can be added along with the gassing agent and/o trace additives and stirred throughout the formulation by conventional means. Packaging and/or further handling should quickly follow the addition of the gassing agent, depending upon the gassing rate, to prevent loss or coalescence of gas bubbles. The formulation process also can be accomplished in a continuous manner as is known in the art.

It has been found to be advantageous to predissolve the emulsifier in the liquid organic fuel prior to adding the organic fuel to the aqueous solution. This method allows the emulsion to form quickly and with minimum agitation. However, the emulsifier may be added separately as a third component if desired.

Table I shows examples of the present invention. Each emulsion composition was mixed with 40% of a nitrate reactive ore, and a differential thermal analysis was run on the mixture. Relative results of these runs also are included in the table. Example 1 contained no urea and showed a strong exotherm commencing at ~57° C. Example 2 contained only 1% urea, but showed a dramatic reduction in exotherm intensity, even though a small exotherm was evident. The exotherm intensity further was reduced by doubling the urea content as shown in Example 3. This low temperature exotherm becomes essentially unobservable as the urea content is increased incrementally in Examples 4 to 8 to near 30%. Comparison Examples 9 and 10 illustrate the invention in compositions containing calcium nitrate.

The compositions of the present invention can be delivered in bulk form to a borehole containing reactive sulfide or pyrite ores, using methods well known in the art, or can be used in packaged form. For safety reasons, a packaged product is preferred over a bulk product in boreholes having reactive ores, particularly where longer sleeptimes of the product in the borehole is anticipated, since the packaging provides some inherent protection. Borehole liners also can provide extra protection in situations where bulk-loaded products are used.

While the present invention has been described with reference to certain illustrative examples and preferred embodiments, various modifications will be apparent to those skilled in the art and any such modifications are intended to be within the scope of the invention as set forth in the appended claims.

TABLE I

| | Reactivity of Sulfide/Pyrite Ore with Emulsion Explosives Containing Urea | | | | | | | | | |
|---|---|---|---|---|---|---|---|---|---|---|
| | 1 | 2 | 3 | 4 | 5 | 6 | 7 | 8 | 9 | 10 |
| Ammonium Nitrate | 75.2 | 75.2 | 74.3 | 73.3 | 70.5 | 61.1 | 40.0 | 53.5 | 63.0 | 60.2 |
| Sodium Nitrate | — | — | — | — | — | 4.7 | 36.4 | 9.4 | — | — |
| Calcium Nitrate[1] | — | — | — | — | — | — | — | — | 14.1 | 14.1 |
| Urea | — | 1.0 | 1.9 | 4.7 | 9.4 | 18.8 | 15.0 | 28.2 | — | 4.7 |
| Water | 18.8 | 17.8 | 17.8 | 16.0 | 14.1 | 9.4 | 3.1 | 2.0 | 16.9 | 15.0 |
| Sorbitan Mono Oleate | 1.2 | 1.2 | 1.2 | 1.2 | 1.2 | 1.2 | 1.4 | 1.2 | 1.2 | 1.2 |
| Mineral Oil | 1.2 | 1.2 | 1.2 | 1.2 | 1.2 | 1.2 | 4.1 | 1.2 | 1.2 | 1.2 |
| #2 Fuel Oil | 3.6 | 3.6 | 3.6 | 3.6 | 3.6 | 3.6 | — | 3.6 | 3.6 | 3.6 |
| Differential Thermal Analysis[2] | | | | | | | | | | |
| Differential Temperature at Exotherm Peak Below 150° C. | 19.6° C. | 0.8° C. | 0.4° C. | <0.4° C. | <0.4° C. | <0.4° C. | <0.4° C. | <0.4° C. | 14.0° C. | <0.4° C. |
| Relative Response Below 150° C.[3] | 1375 | 64 | <60 | <60 | <60 | <60 | <60 | <60 | 1448 | <60 |
| Onset of 1st Exotherm | 57° C. | 64° C. | 62° C. | 180° C. | 182° C. | 178° C. | 206° C. | 184° C. | 45° C. | 150° C. |
| Exotherm Peak | 90° C. | 90° C. | ~76° C. | 222° C. | 232° C. | 238° C. | 248° C. | 241° C. | 83° C. | 226° C. |

[1]Norsk Hdyro industrial grade calcium nitrate.
[2]Thermolysis of reactive sulfide/pyrite ore mixed with explosive, 40% ore, 60% explosive, ~0.3 g sample.
[3]Integration of exotherm peak area.

What is claimed is:

1. A method of blasting in reactive ores containing sulfides and/or pyrites comprising the use of an emulsion explosive having an emulsifier; a continuous organic fuel phase; and a discontinuous oxidizer salt solution phase that further comprises inorganic oxidizer salt, water or a water-miscible liquid and urea in an amount of from about 1% to about 50% by weight of the composition.

2. A method according to claim 1 wherein the urea is present in an amount of from 5% to about 20%.

3. A method according to claim 1 wherein the oxidizer salt solution phase contains water or water miscible liquid.

4. A method of blasting in reactive ores containing sulfides and/or pyrites comprising loading a borehole with an emulsion explosives having an emulsifier; a continuous organic fuel phase; and a discontinuous oxidizer salt solution phase that further comprises inorganic oxidizer salt, water or a water-miscible liquid and urea in an amount of from about 1% to about 30% by weight of the composition, and thereafter detonating the explosive.

5. A method according to claim 4 wherein the urea is present in an amount of from about 5% to about 20%.

6. A method according to claim 4 wherein the oxidizer salt solution phase contains water or water miscible liquid.

7. A method of blasting in reactive ores containing sulfides and/or pyrites comprising the use of an emulsion explosive having an emulsifier; a continuous organic fuel phase; and a discontinuous oxidizer salt solution phase that further comprises inorganic oxidizer salt, water or a water-miscible liquid and urea in an amount of from about 1% to about 30% by weight of the composition.

8. A method of blasting in reactive ores containing sulfides and/or pyrites comprising loading a borehole with an emulsion explosive having an emulsifier; a continuous organic fuel phase; and a discontinuous oxidizer salt solution phase that further comprises inorganic oxidizer salt, water or a water-miscible liquid and urea in an amount of from about 1% to about 30% by weight of the composition, and thereafter detonating the explosive.

* * * * *

UNITED STATES PATENT AND TRADEMARK OFFICE

CERTIFICATE OF CORRECTION

PATENT NO. : 5,159,153

DATED : October 27, 1992

INVENTOR(S) : Don H. Cranney, et al.

It is certified that error appears in the above-identified patent and that said Letters Patent is hereby corrected as shown below:

In Claim 1, line 7, "50%" should read --30%--.

Signed and Sealed this

Seventh Day of July, 1998

Bruce Lehman

*Attest:*

BRUCE LEHMAN

*Attesting Officer*

*Commissioner of Patents and Trademarks*